US009695007B2

(12) United States Patent
Haska et al.

(10) Patent No.: US 9,695,007 B2
(45) Date of Patent: Jul. 4, 2017

(54) DRIVE FOR A BOBBIN-WINDING MACHINE

(75) Inventors: Petr Haska, Ceska Trebova (CZ); Christian Griesshammer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 671 days.

(21) Appl. No.: 14/232,679

(22) PCT Filed: Jun. 29, 2012

(86) PCT No.: PCT/CH2012/000142

§ 371 (c)(1),
(2), (4) Date: May 12, 2014

(87) PCT Pub. No.: WO2013/010281

PCT Pub. Date: Jan. 24, 2013

(65) Prior Publication Data

US 2014/0239114 A1 Aug. 28, 2014

(30) Foreign Application Priority Data

Jul. 15, 2011 (CH) ..... 1187/11

(51) Int. Cl.

| | |
|---|---|
| ***B65H 54/70*** | (2006.01) |
| ***B65H 54/72*** | (2006.01) |
| ***B65H 54/74*** | (2006.01) |
| ***B65H 67/048*** | (2006.01) |

(52) U.S. Cl.

CPC ..... *B65H 54/702* (2013.01); *B65H 54/72* (2013.01); *B65H 54/74* (2013.01); *B65H 67/048* (2013.01); *B65H 2701/31* (2013.01)

(58) Field of Classification Search

CPC ..... B65H 54/702; B65H 54/72; B65H 54/74; B65H 67/048; B65H 2701/31

USPC ..... 242/474.5–474.6

See application file for complete search history.

(56) References Cited

U.S. PATENT DOCUMENTS 4,052,015 A * 10/1977 Hand ..... B65H 67/048 242/474.5

6,286,778 B1 9/2001 Kudrus

FOREIGN PATENT DOCUMENTS

| | | | |
|---|---|---|---|
| CN | 1088538 | 6/1994 | |
| CN | 1120084 | 4/1996 | |
| DE | 2707695 A1 * | 11/1977 | ..... B21C 1/12 |
| DE | 38 27 902 A1 | 2/1990 | |

(Continued)

OTHER PUBLICATIONS

Machine Translation of DE 27 07 695 A1, Nov. 3, 1977.*
PCT Search Report, Sep. 21, 2012.

*Primary Examiner* — William E Dondero
(74) *Attorney, Agent, or Firm* — Dority & Manning, P.A.

(57) ABSTRACT

A drive unit is provided for powering a turret winding head for winding roving onto bobbin tubes. The drive unit comprises a closed housing, a first and a second spindle disposed in a turret base plate, wherein the turret base plate is formed as part of the housing and the spindles are disposed outside of the housing. A first drive is provided for the first spindle and a second drive is provided for the second spindle. The drives are disposed inside the housing, and the first and second drives are each provided with a fan wheel. An intake duct, through which air is drawn in by the fan wheel from outside of the housing, is in each case provided on the intake side of the fan wheel of the first and second drives.

11 Claims, 2 Drawing Sheets

(56) References Cited

FOREIGN PATENT DOCUMENTS

Figure 1:
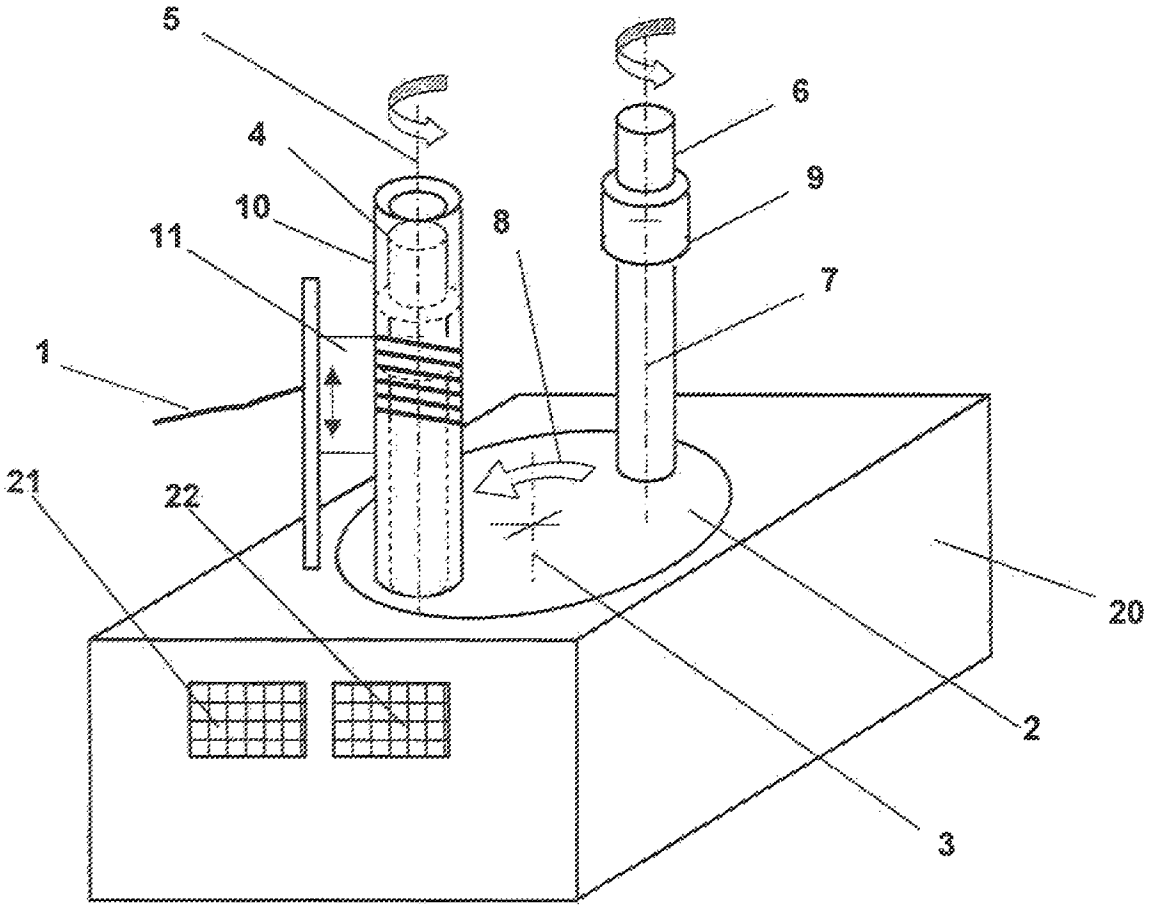

| | | |
|---|---|---|
| EP | 0 927 696 A1 | 7/1999 |
| GB | 2 008 158 | 5/1979 |
| GB | 2 086 440 | 5/1982 |
| JP | 6045621 | 3/1985 |
| JP | 535187 | 5/1993 |
| JP | 635256 | 5/1994 |
| JP | 7977 | 1/1995 |
| JP | 7133505 | 5/1995 |
| JP | 1025059 | 1/1998 |

* cited by examiner

DRIVE FOR A BOBBIN-WINDING MACHINE

FIELD OF THE INVENTION

The present invention relates to a drive unit for powering a turret winding head for winding roving onto bobbin tubes.

BACKGROUND

Roving frames are used for producing so-called rovings or coarse rovings in preparation of the spinning operation for the purpose of obtaining a fiber-type thread, for example on a ring spinning frame. The roving, which serves as the preparatory material for the spinning operation on a ring spinning frame, is usually produced from a drawing frame sliver, which is drawn on drafting rollers of the roving machine and then provided with a slight twist to allow for draft-free winding of the roving onto a bobbin. The intensity of the applied twist may only be such that, on the one hand, it is sufficient to hold the fibers together for the purposes of winding, unwinding and transporting the bobbins. On the other hand, however, this so-called protective twist must be sufficiently small with regard to the drafting on ring spinning frames such that no draft interferences are created in the course of the further processing steps. Despite the incorporated protective twist, the roving must not lose the drafting capacity thereof.

The drawing frame sliver that is used in the production of the ravings consists of so-called short-staple fibers. Preferably used for this purpose are cotton fibers or cotton and artificial fiber blends. When processing natural fibers, such as cotton in the context of a spinning process, dirt or short fibers as well as parts of fibers are separated from the drawing frame sliver and released into the environment. Airborne components of this kind and any deposits that may form because of them pose a hazard for the used machinery. The level of contamination increases, when the operating conditions change, particularly when the production speed for the making of coarse ravings is accelerated.

Modern roving frames for the production of coarse ravings perform at operating speeds that are faster by a factor that is multiple times higher in comparison to earlier machines. The high yield speeds correspondingly require that spinning frames are adapted to new circumstances.

Winding machines that are suited for threads being wound on at continuously high speeds and that do not require any change and/or reduction of the yield output during the replacement operation of a bobbin tube are known from chemical fiber manufacturing. EP 1 053 967, for example, discloses a winding machine of this kind. The winding machine includes a turret winding head that holds two winding pins. A first winding pin is in a winding position, and a second winding pin is in a doffer position. The full bobbins are removed from the winding pins, when the machine is in the doffer position, and then replaced with empty bobbin tubes. When the bobbins, which are disposed in the winding position, are full, the turret is rotated by 180° causing the winding pins to switch positions. Due to the completed turret rotation, the winding-on threads are separated from the full bobbins and taken over by the empty bobbin tubes without interrupting or reducing the yield output. The winding pins are disposed horizontally. The thread guide from which the thread changes to the traversing means is disposed at a certain distance relative to the traversing means itself. This results in a longer path that the thread must traverse from the thread guide to the extreme position of the traversing means, in contrast to the times when the traversing means is in the center position. This is why, with each movement of the traversing means, there results a certain draft. The yarns that are processed by means of the above-described winding machines are continuous polymer threads. Such types of thread typically do not generate dirt or airborne dust nor short fibers that have become separated from the sliver. In contrast, any cotton processing is associated with a great deal of dirt, dust and short fibers or broken off parts of fiber lengths. This is why cotton-processing machines are equipped with cleaning and suction means.

SUMMARY OF THE INVENTION

Therefore, it is an object of the present invention to provide a winding apparatus for a roving that allows for the uninterrupted winding operation of a roving while still being able to keep the apparatus free of contaminations due to raw material exposure, particularly protecting high-maintenance components, such as drive means and bearing points, from contaminations due to airborne or settling dirt particles and short fibers. Additional objects and advantages of the invention will be set forth in part in the following description, or may be obvious from the description, or may be learned through practice of the invention.

The objects are achieved by providing a drive unit for powering a turret winding head for winding roving with the characterizing features of the present invention. The turret winding head comprises a closed housing, wherein a turret base plate is formed as part of the housing. Outside of the housing, a first spindle and a second spindle are disposed in the turret base plate. The first spindle is provided with a first drive, and the second spindle is provided with a second drive, wherein the drive means are disposed inside the housing. The first and second drive means are each equipped with a fan wheel. On the intake side of the fan wheel, the first drive and the second drive are provided each with an intake duct, through which air is drawn in by the fan wheel from outside of the housing.

In terms of the structural design, the turret winding head according to the invention is similar to the known turret winding head from the technical field of chemical fiber engineering. However, in contrast to conventional turret winding heads, the turret base plate is disposed horizontally and the spindles, that are supported on the turret base plate, are disposed vertically. This way, it is possible to use flyer tubes, as known according to the prior art, for the winding operation. The resulting advantage is the compatibility with finishing spinning processes downstream, and without any need for rewinding or even refitting steps with regard to the machines that are disposed downstream. Known flyer tubes are disclosed, for example, in EP 0 927 696.

To keep contaminations away from the drive means of the spindles and the turret base plate, the drives are accommodated inside a housing below the turret base plate. The drive units comprise the motors as well as any necessary transmission means and power-transmitting elements, such as belt drives or clutches and brakes, other types of equipment needed for powering the different elements. The turret base plate constitutes therein a part of the housing. The motors for powering the spindles are provided with a fan wheel. Since one of the two spindles is always in operation during the winding process, and therefore also the associated drive of the given spindle, the corresponding fan wheel is also used for directing air over the cooling fins of the motor in order to cool the motor. The invention takes advantage of this circumstance. Accordingly, an intake duct is provided on the suction side of the fan wheel that connects an opening in the housing with the intake opening of the fan wheel. This causes the fan wheel to draw in air from outside of the housing, and whereby the air is blown into the housing. Each of the two spindle drives is provided with a separate intake duct for the respective fan wheel thereof. The two intake ducts also connect two independent openings to the respective fan wheel. Preferably, each intake duct is equipped with a filter. This filter prevents dust and dirt, which are drawn in by a fan wheel, from being carrier into the housing. Adjusted to the associated requirements for the dust concentrations inside the housing, different structural filter designs are possible. A simple mesh grating is conceivable, as are filters made of a textile fabric, as well as other filters that are know from the prior art.

The housing is not embodied as air-tight or dust-proof. This is why, correspondingly, no sealing organ is provided inside the intake duct for sealing the same. In addition, sealing the rotatable turret base plate relative to the housing wall it is also not necessary. The air that is drawn in by the respectively operating fan wheel is blown into the interior of the housing resulting in excess pressure inside the housing relative to the exterior environment. When the excess pressure reaches a certain value, the air escapes automatically through any available, intentionally provided leaks and into the exterior environment. The excess pressure that is present inside the housing corresponds to the pressure loss through all available leaks, regulating itself automatically based on the size of the leaks. For example, one of these leaks is the intake duct of the spindle drive that is in the doffer position, which is not in operation at that given time. The excess pressure inside the housing prevents any penetration of contaminants, thus ensuring a high level of operational reliability even in dust environments.

Preferably, the drive means of a spindle is an electric motor with an attached fan wheel. However, hydraulic or pneumatic drives are also conceivable. A belt drive is provided for the power transmission from the electric motor to the spindle. Due to the apparatus and prevailing speeds, it is advantageous to provide for a transmission that is disposed between the electric motor and the belt drive. The first drive of the first spindle and the second drive of the second spindle are installed together with the associated intake ducts in a stationary manner inside the housing. Due to the fact that, with each rotation of the turret, the spindles respectively change positions in relation to the motors, a belt drive is advantageous, which is disposed via belt wheels, that are supported on a hollow shaft, inside the turret axis. With an apparatus of this kind, it is also possible to achieve a stabilization of the turret base plate, due to the forces that are applied to the axis of the turret base plate, owing to the mirror-image-like arrangement of the motors. The turret base plate is held in a defined position by the belt holding forces of the first drive from the one side of the turret base plate axis and the belt holding forces of the second drive from the other side of the turret base plate axis. The turret base plate itself can be powered by a motor provided with a belt drive or chain drive. A direct drive via a corresponding ring gear is conceivable as well.

During the operation of the turret winding head, the air that is drawn in by the air wheel of the respective drive that is in the operating state is supplied via a filter through the intake duct from the outside of the housing to the drive means. Because air is drawn in from outside of the housing, excess pressure results inside the housing, the measure of which is determined by the available leaks inside the housing and the intake duct of the drive that is not in operation. The air that escapes to the outside through the intake duct of the drive that is not in operation furthermore results in a cleaning action of this intake duct and of the filter that is installed in the intake duct. The level of the negative pressure can be established based on the number and the size of the leaks inside the housing. Preferably, the negative pressure and the structural design as well as the filter size of the filters that are provided in the intake ducts are selected such that they have the capacity to function as self-cleaning filters inside the intake ducts.

The invention will be described in further detail based on the figures below.

DETAILED DESCRIPTION

Reference will now be made to embodiments of the invention one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 is a schematic representation of a turret winding head. A turret base plate 2 is held inside a housing 20 and rotatably supported therein. The turret base plate 2 is disposed horizontally and has a vertical axis of rotation 3. The turret base plate 2 is rotated by a drive about the axis of rotation 3, particularly in steps of 180°, corresponding to the arrow 8. A first spindle 4 and a second spindle 6 are held and rotatably supported in the turret base plate 2. The first spindle 4 is connected to a drive means via the axis of rotation 5. The second spindle 6 is connected to a drive means via the axis of rotation 7. The first and second spindles 4, 6 are powered independently of each other. Advantageously, the drive means of the first and second spindles 4, 6 are provided with a frequency control.

In the representation in FIG. 1, the first spindle 4 is in the winding position. An empty bobbin tube 10 has been placed onto the spindle 4. A roving 1 is wound onto the bobbin tube 10. The roving 1 is wound onto the bobbin tube via the traversing means 11. The traversing means 11 are connected to the housing 20 and held by said housing. The traversing means 11 comprise a movable element that moves up and down along the bobbin tube 10, whereby the bobbin tube 10 is evenly wound with the roving while rotating around the axis of rotation 5.

In the representation in FIG. 1, the second spindle 6 is in the duffer position. The full bobbin tube has already been removed from the second spindle 6. The removal of full bobbin tubes and the placement of empty bobbin tubes 10 can be effected automatically by the use of the corresponding manipulating means or robots. The spindle 6 is provided with a fastening element 9 in the upper region thereof. The fastening element 9 stabilizes the bobbin tube 10 on the spindle 6. An empty bobbin tube 10 is placed from above downward and onto the spindle 6 and subsequently held in place in a torque-proof manner by the fastening element 9. The fastening element 9 can be, for example, a pneumatic clamping device that is rendered pressureless after the bobbin tube has been placed, whereby it is caused to undergo a radial expansion resulting in the bobbin tube being clamped on the spindle 6.

When the bobbin tube 10 has been provided with a full winding, the turret base plate 2 is rotated by one half of a revolution (180°) around the axis 3 in the direction of the arrow 8. This causes the first and the second spindles 4, 6 to switch positions. The traversing means 11 are not taken along by the rotation of the turret base plate 2. The rotation of the turret base plate 2 causes the empty bobbin tube 10, which is disposed on the second spindle 6, to be rotated into the winding position and thereby rotated into the course of the roving 1. This causes the roving 1 to be taken over by the empty bobbin tube 10 and separated from the full bobbin tube. For the take-over of the roving 1 by the empty bobbin tube, the same is provided with a catch device at a certain location. The traversing means 11 guide the roving 1 to the point of the catch device. As soon as the roving 1 has been caught and taken over by the empty bobbin tube, the traversing means 11 begin with the even winding action of the roving 1 onto the empty bobbin tube by performing a controlled upward and downward motion.

Openings for connecting intake ducts are provided in the walls of the housing 20, which are each closed by a filter 21, 22.

Figure 2:
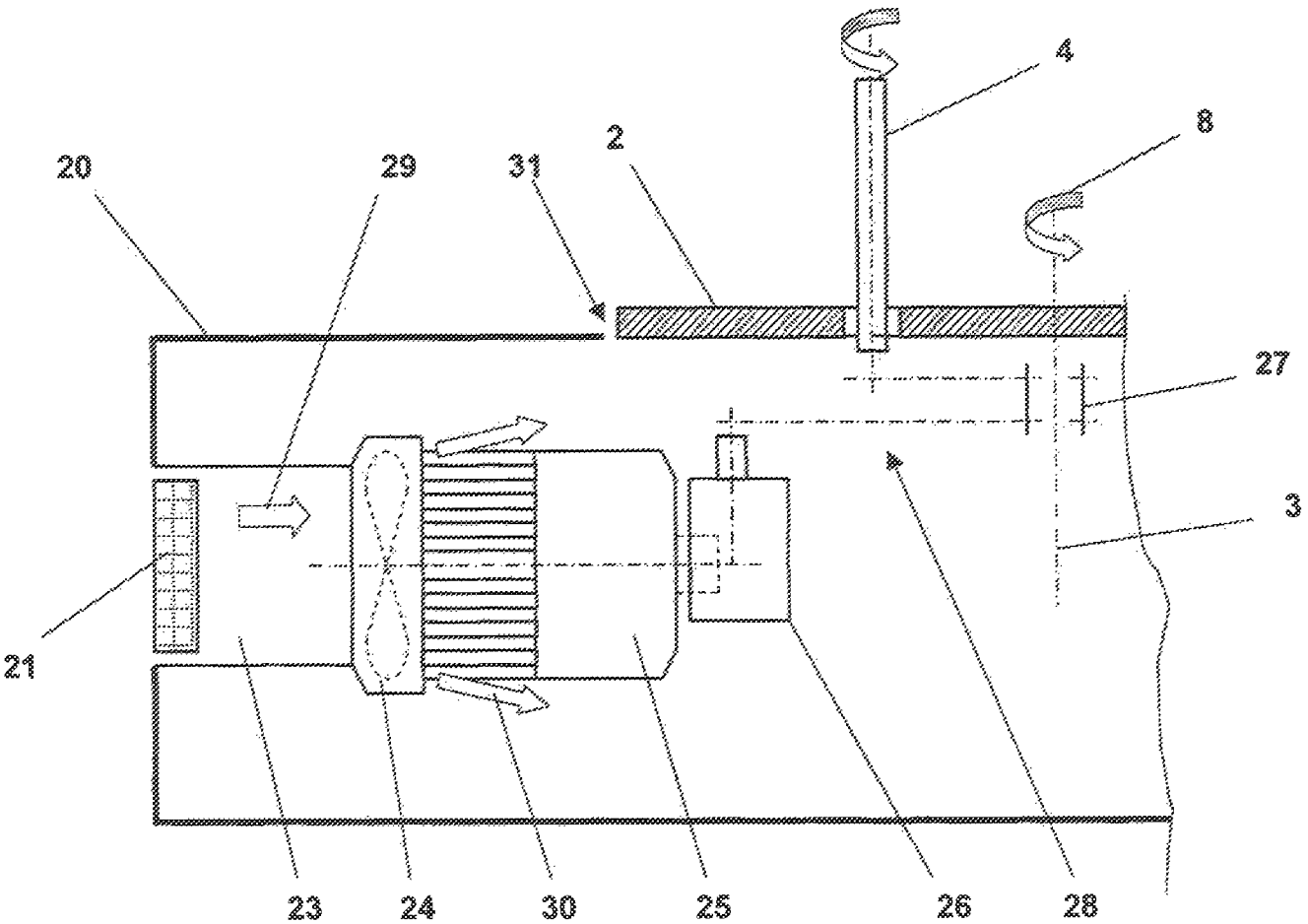

FIG. 2 shows a schematic depiction of a partial cross-section through a turret winding head according to FIG. 1. The turret base plate 2 represents a part of the housing 20. An amount of play 31 is present between the turret base plate 2 and the housing 20. The turret base plate 2 is supported inside the housing 20 by the axis of rotation 3 and able to rotate powered by a drive (not shown) in the direction of the arrow 8. The first spindle 4 is held and supported in the turret base plate 2. The electric motor 25 for driving the spindle 4 is fastened in a stationary manner inside the housing 20. The electric motor 25 is provided with a fan wheel 24. The motor shaft of the electric motor 25 transitions into a transmission 26, followed by a belt drive 28. The belt drive 28 causes the spindle 4 to rotate. The belt drive 28 is designed in two stages and guided via a hollow shaft 27, which is disposed in the axis of rotation 3 of the turret base plate 2. With this arrangement, it is possible, when changing bobbin tubes from the first spindle 4 to the second spindle, to rotate the turret base plate 2 by 180° without having to change the position of the drive of the spindle 4.

An intake duct 23 is connected to the intake side of the fan wheel 24. The intake duct 23 creates a connection from the fan wheel 24 to an opening inside the housing 20. A filter 21 is installed in the opening of the housing 20. When operating the electric motor 25, the fan wheel 24 is also powered and draws in air via the filter 21 from outside of the housing 20, thereby creating an intake flow 29. The electric motor 25 is in the operating state, when the spindle 4 is in the winding position. The intake flow 29 is directed from the fan wheel 24 over the cooling fins of the electric motor 25 to the inside of the housing 20 resulting in an incoming air flow 30. The air that the fan wheel 24 previously blew into the housing 20 escapes again through intentionally created leaks inside the housing 20. Leaks are formed, for example, by the intake duct of the non-operating drive of the spindle that is in the duffer position or the play 31 that exists between the housing 20 and the turret base plate 2. Further leaks can be provided, for example, at points along the seams of the housing walls. The excess pressure that is created inside the housing 20 due to the incoming air flow 30 ensures that there is always a flow of aft at the leak points from the inside of the housing 20 to the outside. This prevents dust and dirt from penetrating the inside of the housing 20 and improves the operational reliability of the drive unit overall.

Modifications and variations can be made to the embodiments illustrated or described herein without departing from the scope and sprit of the invention as set forth in the amended claims.

LEGEND

1 Roving
2 Turret base plate
3 Axis of rotation of the turret base plate
4 First spindle
5 Axis of rotation of the first spindle
6 Second spindle
7 Direction of rotation of the second spindle
8 Direction of rotation of the turret base plate
9 Fastening element
10 Bobbin tube
11 Traversing means
20 Housing
21, 22 Filter
23 Intake duct, drive of the first spindle
24 Fan wheel
25 Electric motor
26 Transmission
27 Belt drive
28 Hollow shaft
29 Intake flow
30 Incoming air flow
31 Play between housing and turret base plate

The invention claimed is:

1. A turret winding head for winding a roving onto bobbin tubes in a roving frame, comprising:

a closed housing;

a rotatable turret base plate that forms part of the closed housing;

a first and a second spindle disposed on the turret base plate outside of the closed housing;

a first drive for the first spindle, and a second drive for the second spindle, the first and second drives disposed within the closed housing; and the first and second drives each comprising a fan wheel and a respective intake duct on an intake side of the fan wheel through which a suction air flow is drawn by the fan wheel directly from outside of the closed housing through the intake duct.

2. The turret winding head as in claim 1, further comprising a filter within each of the intake ducts.

3. The turret winding head as in claim 1, wherein the closed housing comprises intentional leak points for escape of drawn in air when either of the first or second spindles is in an operational winding state.

4. The turret winding head as in claim 3, wherein an excess pressure is established within the closed housing in an operational winding state of either of the first or second spindles.

5. The turret winding head as in claim 1, wherein the turret base plate is horizontally disposed, and the first and second spindles are vertically disposed on the turret base plate.

6. The turret winding head as in claim 1, wherein the first and second drives each comprise an electric motor and a belt drive system.

7. The turret winding head as in claim 6, wherein the first and second drives are stationary mounted within the closed housing.

8. A method for operating a turret winding head for winding a roving onto bobbin tubes in a roving frame, the turret winding head including: a closed housing, a first spindle powered by a first drive; a second spindle powered by a second drive; the first and second drives disposed within the closed housing and each provided with a fan wheel, the method comprising:

alternating an operating winding state of the first and second drives; and drawing outside air into the closed housing by the fan wheel of the operational one of the first or second drives through a filter and individual respective intake duct associated with the operational drive and connected directly between the operational drive and outside air through the closed housing.

9. The method as in claim 8, further comprising drawing sufficient air through the intake duct and filter so as to create an excess pressure conditions within the closed housing.

10. The method as in claim 9, further comprising controlling escape of the drawn-in air from the closed housing via intentional leak points from the closed housing, including a reverse flow through the intake duct associated with the non-operational drive.

11. The method as in claim 10, further comprising cleaning the filter in intake duct of the non-operational drive with the reverse flow.

* * * * *